US010577824B1

(12) United States Patent
Crandall et al.

(10) Patent No.: US 10,577,824 B1
(45) **Date of Patent: *Mar. 3, 2020**

(54) FENCE BRACE

(71) Applicants: Fonda Crandall, Reno, NV (US); Joseph Crandall, Reno, NV (US)

(72) Inventors: Fonda Crandall, Reno, NV (US); Joseph Crandall, Reno, NV (US)

( * ) Notice: Subject to any disclaimer, the term of this patent is extended or adjusted under 35 U.S.C. 154(b) by 201 days.

This patent is subject to a terminal disclaimer.

(21) Appl. No.: 15/856,673

(22) Filed: Dec. 28, 2017

Related U.S. Application Data

(62) Division of application No. 14/863,793, filed on Sep. 24, 2015, now Pat. No. 10,030,408.

(51) Int. Cl.
*E04H 17/14* (2006.01)

(52) U.S. Cl.
CPC . *E04H 17/1413* (2013.01); *E04H 2017/1473* (2013.01); *E04H 2017/1482* (2013.01)

(58) Field of Classification Search
CPC ..... E04H 17/1413; E04H 17/1417; E04H 17/1421; E04H 17/1426; E04H 17/143; E04H 17/1434; E04H 2017/1447; E04H 2017/1452; E04H 2017/1473
See application file for complete search history.

(56) References Cited

U.S. PATENT DOCUMENTS 4,526,348 A * 7/1985 Cammack ..... E04H 17/1413 256/65.06
5,186,571 A * 2/1993 Hentzschel ..... E04B 1/2608 256/65.06
6,290,214 B1 * 9/2001 DeSouza ..... E04H 17/1413 256/55
6,802,496 B1 * 10/2004 Preta ..... E04H 17/1413 16/253

FOREIGN PATENT DOCUMENTS

GB 677092 * 12/1949 ..... E04H 17/1413

* cited by examiner

*Primary Examiner* — Michael P Ferguson

(57) ABSTRACT

The present invention comprises a brace adapted to secure a fence rail to a fence post. This brace may optionally be installed onto an existing fence. The present invention may also be installed on a new fence. The brace may be adapted to support fences with cylindrical fence posts or rectanguloid fence posts and rectanguloid fence rails. Optional embodiments include braces for fence corner pieces. The brace may further optionally be adapted to secure fences on a steep incline. The invention includes a first fence rail brace member adapted to connect to 2 or more sides of a first fence rail; the first fence rail brace member is fused to a first side of a fence post brace member, the fence post brace member being adapted to connect to 2 or more sides of the fence post.

4 Claims, 7 Drawing Sheets

FENCE BRACE

RELATED APPLICATIONS

This application is a divisional application of U.S. patent application Ser. No. 14/863,793 filed on Sep. 24, 2015, now U.S. Pat. No. 10,030,408. The subject matter of the aforementioned application is hereby incorporated by reference.

FIELD OF THE INVENTION

The present invention relates to the field of fences. More particularly, the present invention relates to the field of systems for providing structural support for fences.

BACKGROUND OF THE INVENTION

Fence and fence structures are subject to damage due to high winds, torrential rains, heavy snowfall, vehicular accidents, termites, vandalism, earthquakes and falling trees and branches. The most common of these causes is high winds. Wind damages fences all around the world every year. Fences made of wood are especially susceptible to wind damage because wood is weakened by prolonged exposure to rain, snow, wind, and other elements. Despite the potential for damage, wood is still by far the most common residential fencing material in the United States. In 2007 alone, Americans put up 59,000 miles of wood fencing, enough to circle the globe twice. Wood is inexpensive and lightweight and a wood fence can easily be shaped to give properties character and individuality. There are many styles, including linear post-and-rail and crisscrossing lattice, as well as myriad picket patterns and post-cap designs. And the wood may be painted or stained to match almost any landscape.

Fences could be built much stronger through the use of heavy materials such as steel and sturdy construction. However, this might drive the cost of the fence up above what is acceptable. As well, there are the aesthetic considerations discussed above. Also, it is unlikely that a property owner would replace an existing fence merely because of the possibility that it could be damaged by the elements.

Therefore there is an unmet need for an inexpensive way to provide a fence with additional structural support. The need is especially great with respect to existing fences and with respect to wooden fences.

SUMMARY OF THE INVENTION

The present invention fills the needs described above. It provides a way for an existing fence to be strengthened. The fence would not need to be removed or modified to install the brace. Installation would be simple. The brace could be mass produced at low cost. The color and style of the brace could be easily adapted to mesh aesthetically with the fence and the surrounding area. The brace itself may be painted or stained. The brace may also be built into a new fence. The present invention optionally includes embodiments adapted for fences with rectanguloid rails or for rectanguloid fence posts. The present invention may be optionally optimized for a fence with cylindrical fence posts. The present invention also may include an embodiment adapted to secure the corner pieces of the fence. In an additional optional embodiment, the present invention is adapted to secure a fence on a slope. The brace may be made of strong weather-resistant material such as steel, stainless steel, galvanized steel, aluminum, plastic, graphite, composite material, or wood.

DETAILED DESCRIPTION OF THE INVENTION

In the following detailed description of the preferred embodiment, reference is made to the accompanying drawings, which from a part of this application. The drawings show, by way of illustration, specific embodiments in which the invention may be practiced. It is to be understood that other embodiments may be utilized and structural changes may be made without departing from the scope of the present invention.

The following is a listing of the reference numbers included in the original drawings and the element that each reference number corresponds to and a brief description:

1. A fence brace.
2. A fence post.
3. A first fence rail brace member.
4. A first fence rail.
5. A fence post brace member.
6. A second fence rail brace member
7. A second rectanguloid fence rail.
8. A plurality of holes.
9. At least one board.
10. A slot.
11. An arc-shaped fence post brace member.
12. A first corner piece.
13. A second corner piece.
14. A screw.
15. A screw hole.
16. A perpendicularly disposed flap.
17. A second fence rail.

Figure 1:
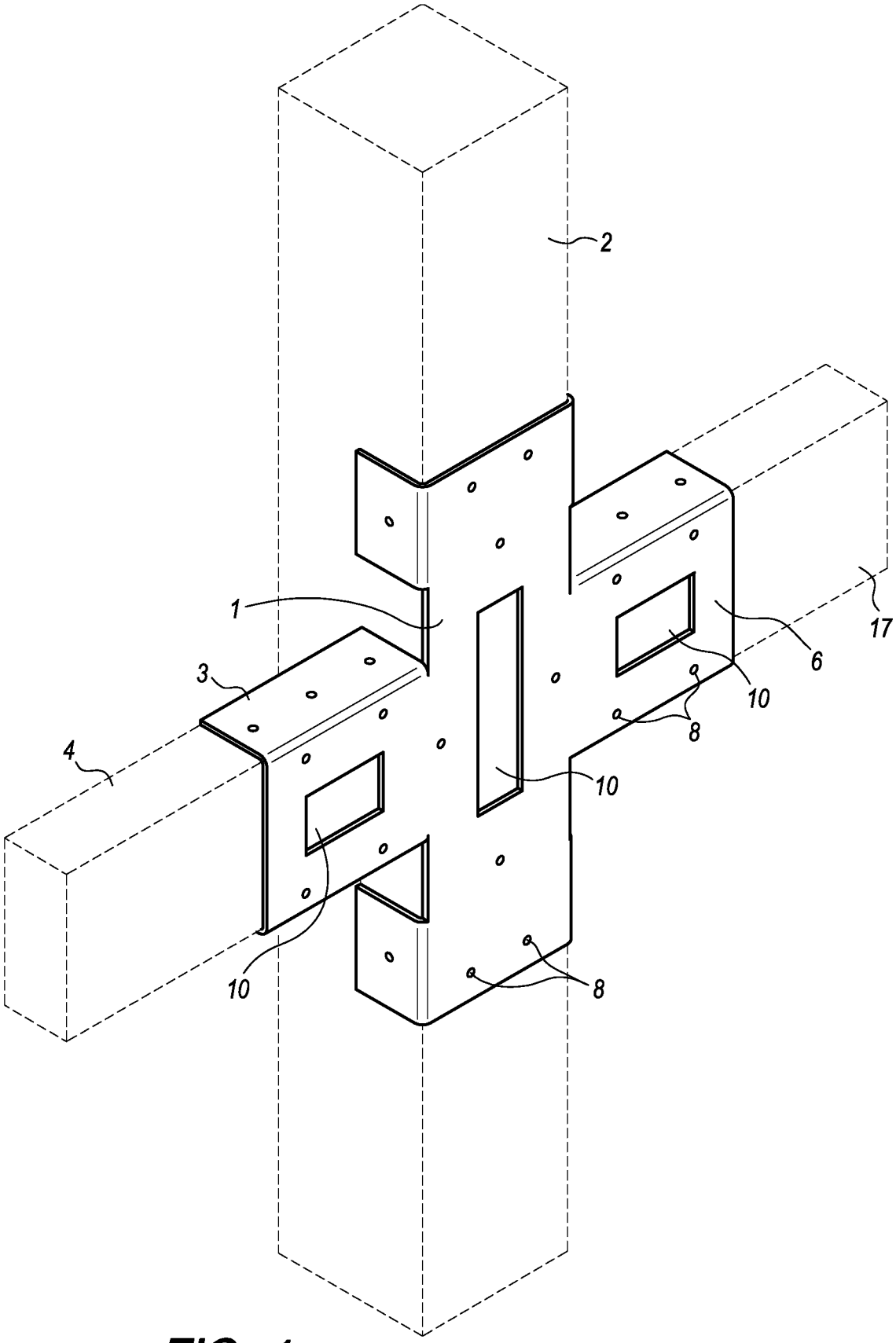
FIG. 1 shows a fence brace according to the present invention that supports a connection between a rectanguloid fence post to 2 linearly disposed rectanguloid fence rails according to the present invention.
Figure 5:
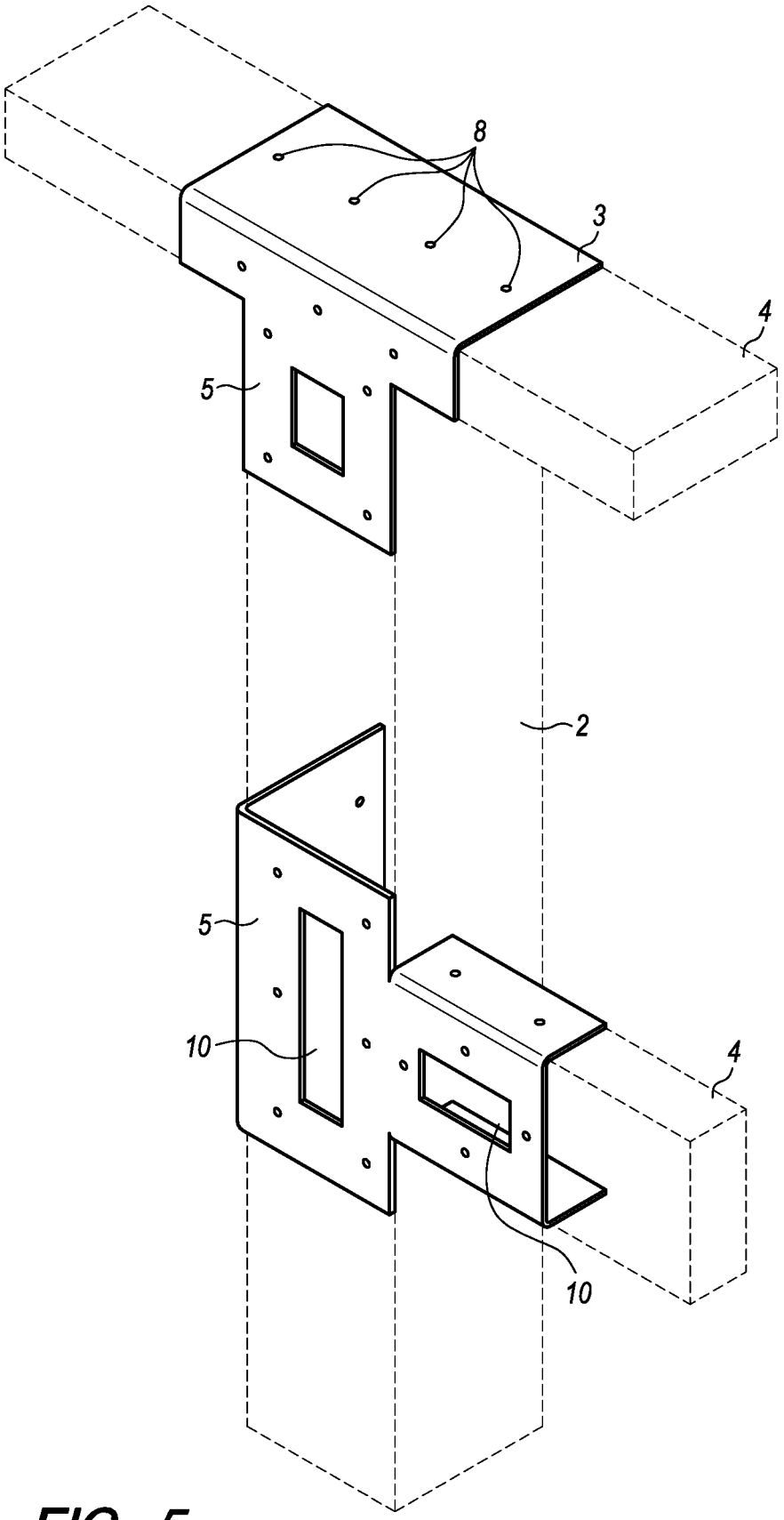
FIG. 5 shows alternate embodiments of the brace according to the present invention adapted to support the connection between a rectanguloid fence post and a rectanguloid fence rail.
Figure 6:
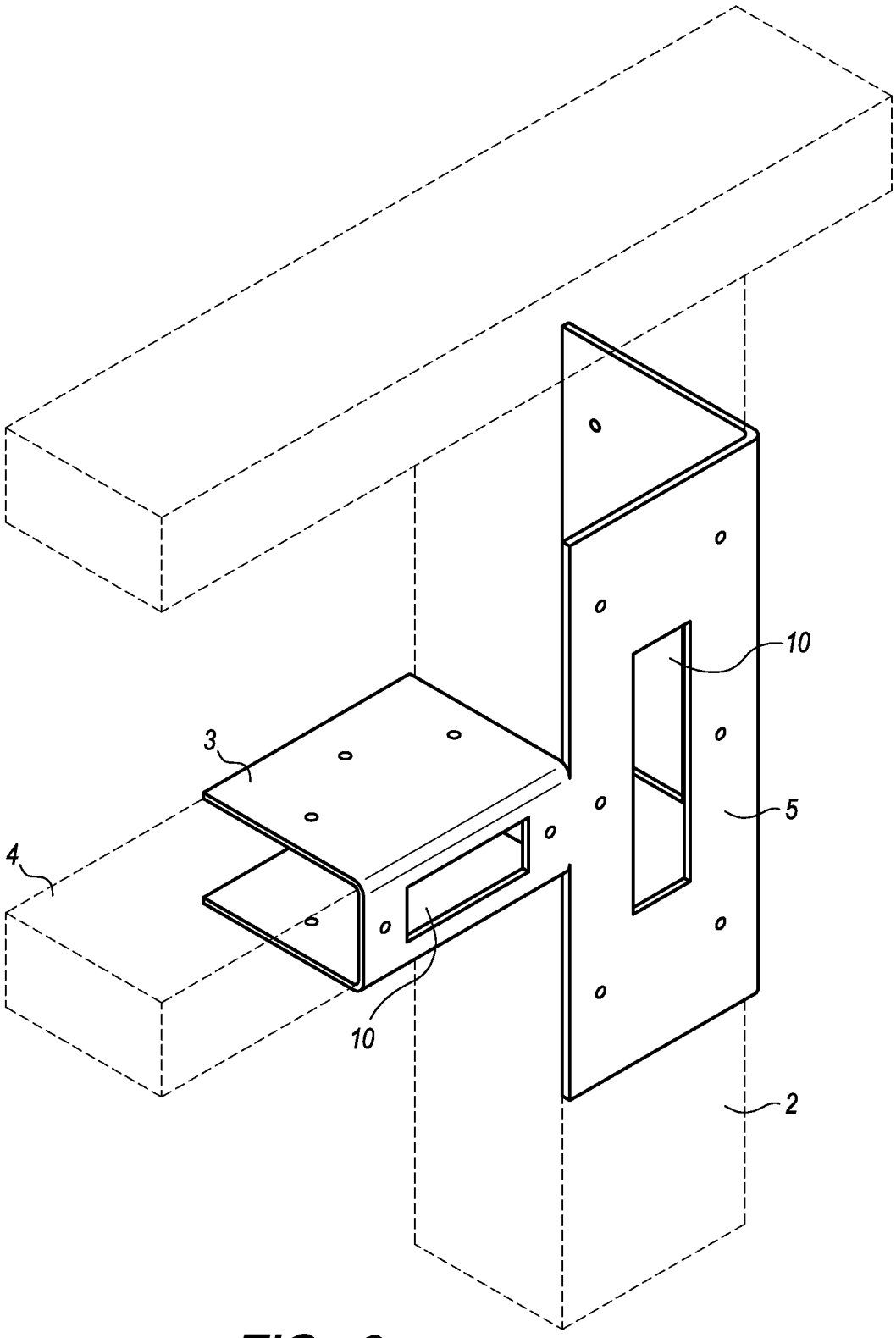
FIG. 6 shows an alternate embodiment of the brace according to the present invention adapted to support the connection between a rectanguloid fence post and a rectanguloid fence rail.

In a first embodiment as best shown in FIG. 1, FIG. 5 and FIG. 6, the present invention comprises a fence brace for securing at least one fence rail to a fence post including a first fence rail brace member adapted to connect to 2 or more sides of a first fence rail. The first fence rail brace member may be fused to a first side of a fence post brace member, the fence post brace member being adapted to connect to 2 or more sides of the fence post. The fence rail may be rectanguloid. As used herein, the term "rectanguloid" means a solid (3-dimensional) object which has six faces that are rectangles. It has the same cross-section along a length. As used herein, a "rectanguloid" is the same as a "rectangular prism." A rectanguloid may be thought of as a 3 dimensional version of a rectangle or a square. Where the fence post is rectanguloid, the present invention would further include a second fence rail brace member fused to a second side of the fence post brace member, the second fence rail brace member being adapted to connect to 2 or more sides of a second rectanguloid fence rail. The present invention may optionally include a second fence rail brace member fused to a second side of the fence post brace member, the second fence rail brace member being adapted to connect to 2 or more sides of the rectanguloid fence rail. The fence brace may include a plurality of holes thereby allowing the fence post brace member to be securely fastened to the fence post and thereby allowing the fence rail brace member to be securely fastened to the fence rails. The brace may be made of a strong weather-resistant material such as selected from the group consisting of steel, stainless steel, galvanized steel, aluminum, plastic, graphite, composite material, or wood. The first embodiment of the present invention may further include at least one board, wherein the fence post brace member has a slot, and the board is to be fastened to the fence post by passing a screw through the board and through the slot and into the fence post. As well, the brace may include at least one board, wherein the fence post brace member has a slot, and the board is fastened to the fence rail by passing a screw through the board and through the slot and into the fence rail. FIG. 5 at the top shows this embodiment where the fence rail passes above the top of the fence post. FIG. 5 at the bottom shows this embodiment where the fence rail terminates at the fence post. FIG. 6 shows an alternate view of this embodiment where the fence rail terminates at the fence post.

Figure 2:
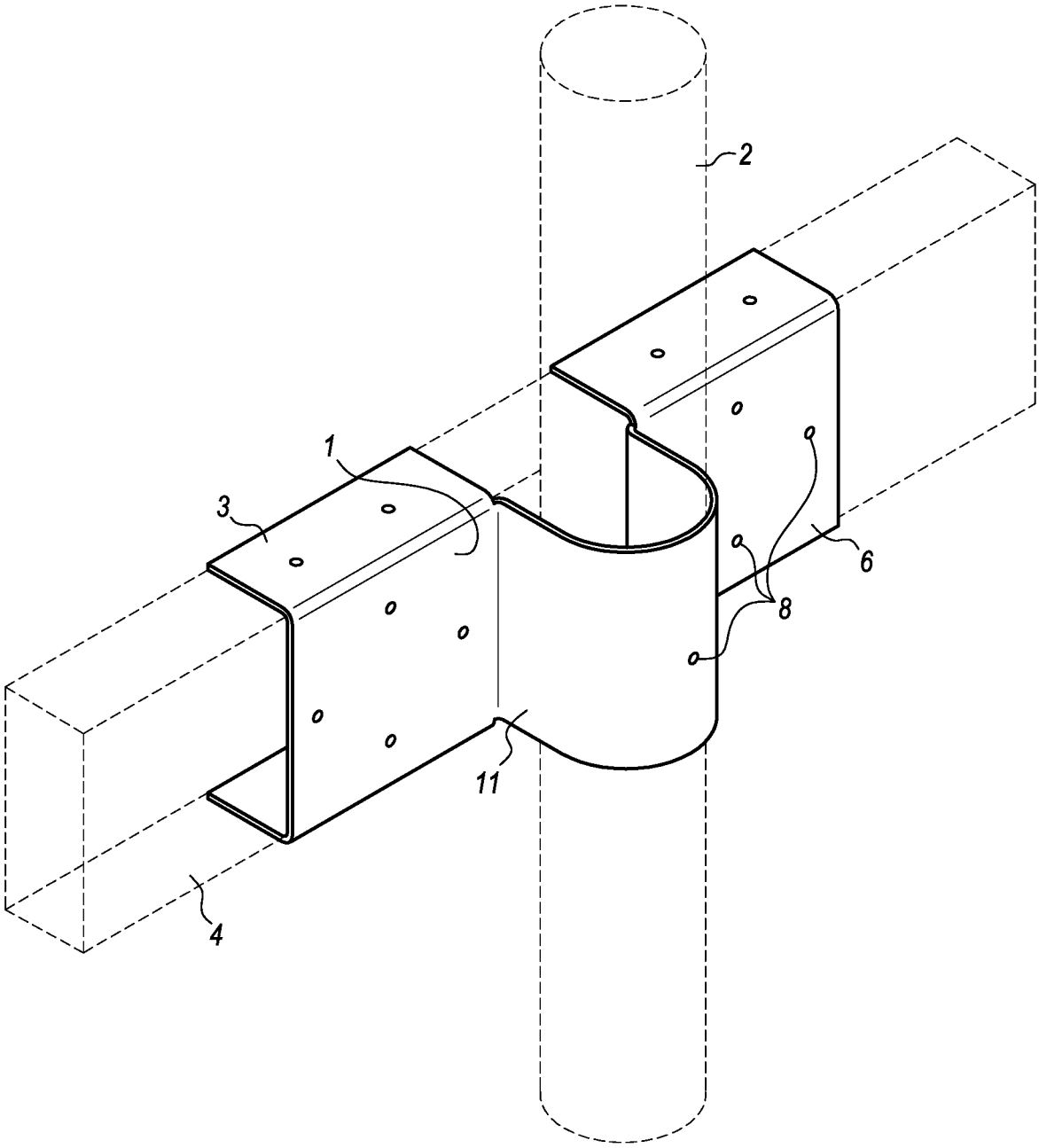
FIG. 2. Shows a fence brace according to the present invention that supports a connection between a rectanguloid fence rail and a cylindrical fence post.

In a second embodiment as best shown in FIG. 2, the present invention is adapted for use with a fence having cylindrical fence posts. Therefore, the fence brace is adapted to secure at least one rectanguloid fence rail to a cylindrical fence post. Specifically, a first fence rail brace member is adapted to connect to 2 or more sides of a first rectanguloid fence rail. The first fence rail brace member is fused to a first side of an arc-shaped fence post brace member, the arc shaped fence post brace member being adapted to surround the cylindrical fence post. A second side the arc-shaped fence post brace member connects to the fence rail. Optionally, a second fence rail brace member adapted to connect to 2 or more sides of the first rectanguloid fence rail, wherein the second fence rail brace member is fused to a second side of the arc-shaped fence post brace member. This second embodiment may further include a second fence rail brace member adapted to connect to 2 or more sides of a second rectanguloid fence rail, wherein the second fence rail brace member is fused to a second side of the arc-shaped fence post brace member.

As in the first embodiment, the fence brace further may include a plurality of screw-holes, nail holes, bolt holes or other such holes. This allows the fence post brace member to be securely fastened to the fence post and thereby allowing the fence rail brace member to be securely fastened to the fence rails.

Figure 3A:
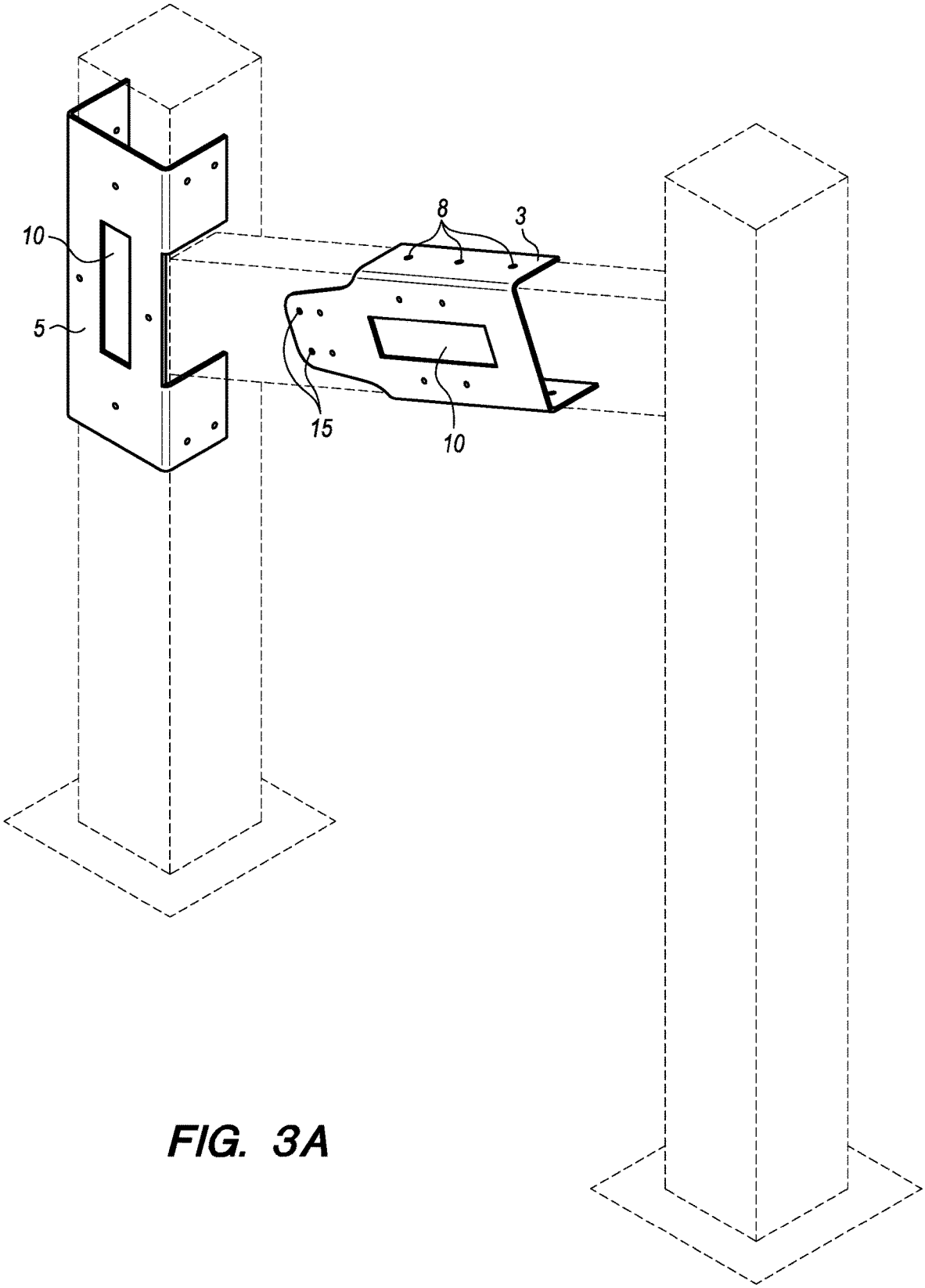
FIG. 3A shows an fence brace according to the present invention adapted to support the connection between a rectanguloid fence rail to a rectanguloid fence post disposed on a slope pictured prior to the brace being secured.
Figure 3B:
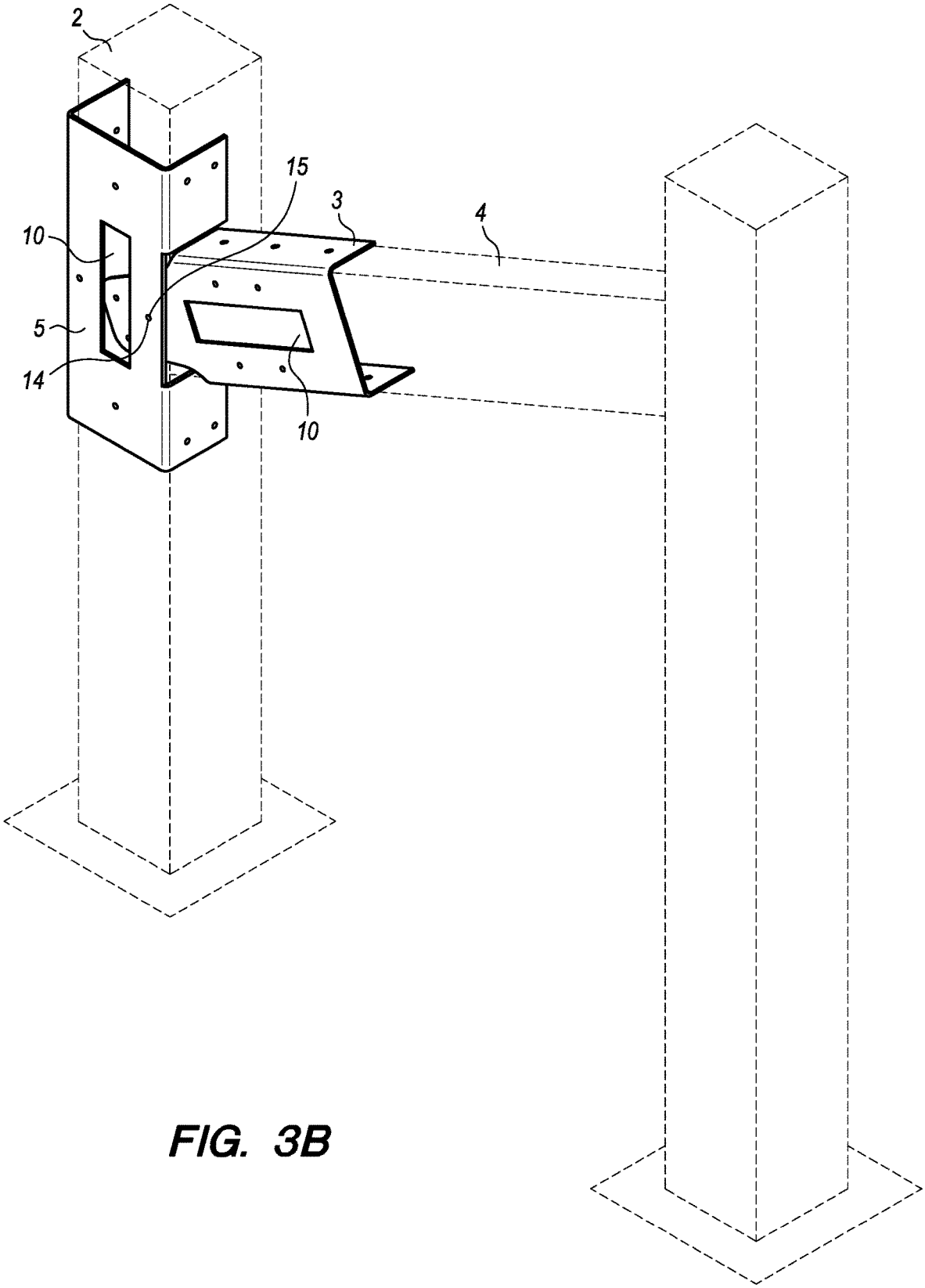
FIG. 3B shows the embodiment of FIG. 3A in a secured position.

In a third embodiment as shown in FIGS. 3A and 3B, the fence brace is adapted to secure a rectanguloid fence post to a rectanguloid fence rail on a slope. This embodiment includes a fence rail brace member adapted to connect to 2 or more sides of a first rectanguloid fence rail. It further includes a fence post brace member adapted to connect to 2 or more sides of the rectanguloid fence post. The fence post brace member has a slot and 2 or more screws may be included. The fence rail brace member has at least one screw hole disposed underneath the slot of the fence post brace member, and the screw passes through the slot of the fence post brace member, and then through the screw hole of the fence rail brace member into the fence post, thereby allowing the fence post brace member to be securely fastened to the fence rail brace member and to the fence post. Optionally, the fence brace is made of weather-resistant material such as steel, stainless steel, galvanized steel, aluminum, plastic, graphite, composite material, and wood. Optionally, at least one board may be included, wherein the fence rail brace member has a slot, and the board is fastened to the fence rail by passing a screw through the board and through the slot and into the fence rail. As well, the fence brace may include a plurality of holes thereby allowing the fence post brace member to be securely fastened to the fence post and thereby allowing the fence rail brace member to be securely fastened to the fence rails.

Figure 4:
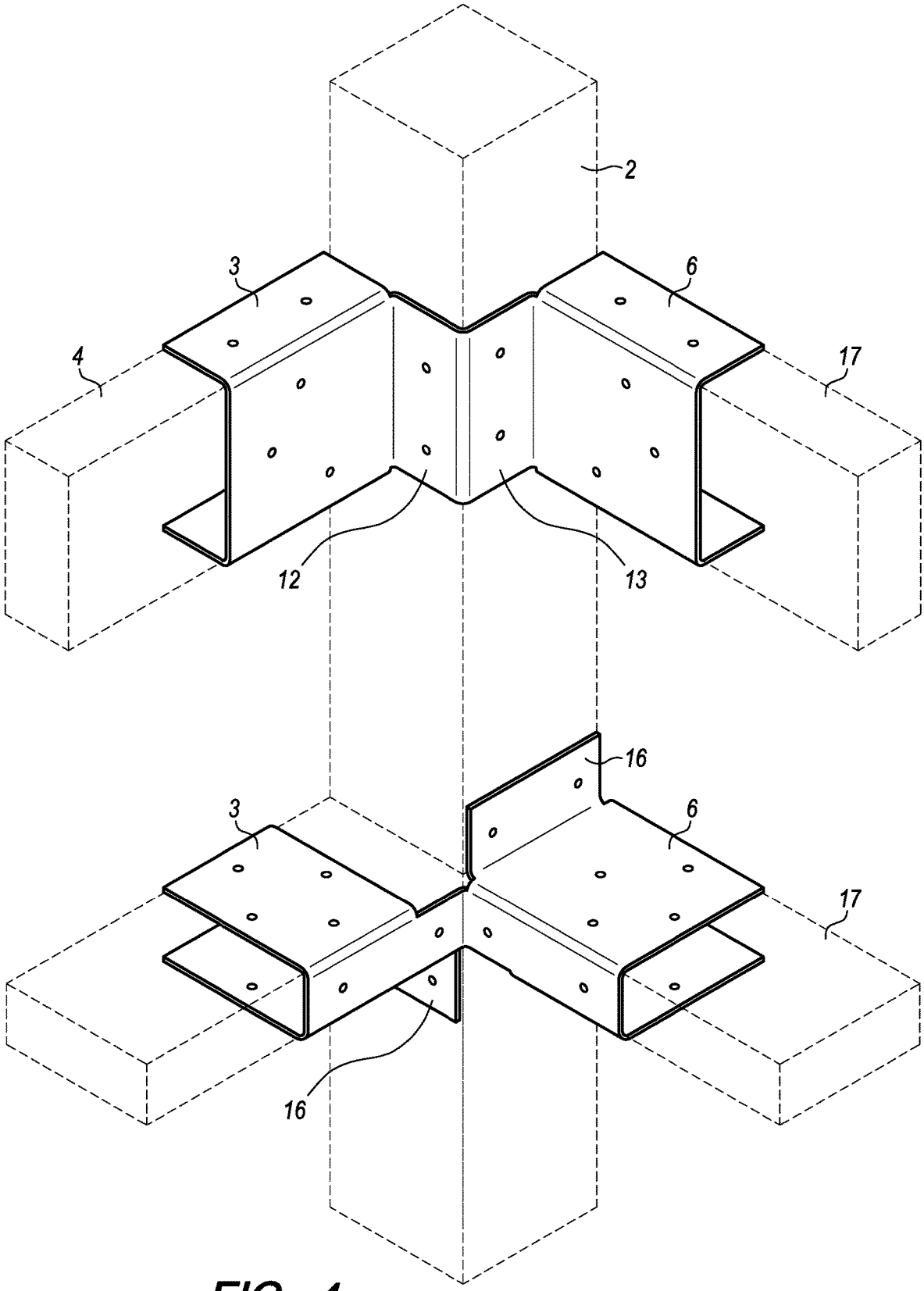
FIG. 4 shows 2 embodiments of a fence brace according to the present invention adapted to support the connection 2 rectanguloid fence rails to a rectanguloid fence post at (for instance) a corner.

In a fourth embodiment as best shown in FIG. 4, the fence brace is adapted to secure 2 rectanguloid fence rails to a rectanguloid fence post at an angle. Without limitation, this embodiment would be useful for securing the corner of a rectangularly fenced off yard. This embodiment includes a first fence rail brace member adapted to connect to 2 or more sides of a rectanguloid fence rail, and a second fence rail brace member adapted to connect to 2 or more sides of the a second rectanguloid fence rail. The second fence rail brace member is fused to a first end of the first fence rail brace member, and the first fence rail brace member has at least one perpendicularly fused flap disposed to connect the first fence rail brace member to the rectanguloid fence post. The second fence rail brace member has at least one perpendicularly fused flap disposed to connect the second fence rail brace member to the rectanguloid fence post. As in earlier embodiments, a plurality of screw-holes, nail holes, bolt holes, or other such holes may be included thereby allowing the fence post brace member to be securely fastened to the fence post and thereby allowing the fence rail brace member to be securely fastened to the fence rails.

In a fifth embodiment as best shown in FIG. 4, the fence brace is adapted to secure 2 rectanguloid fence rails to a rectanguloid fence post at an angle. There is a first fence rail brace member adapted to connect to 2 or more sides of a rectanguloid fence rail. The second fence rail brace member is adapted to connect to 2 or more sides of a second rectanguloid fence rail. There is a first corner piece and a first side of the first corner piece is fused to a first side of the first fence rail brace member a second corner piece wherein a first side of the second corner piece is fused to a first side of the second fence rail brace member. The second side of the first corner piece is fused to the second side of the second corner piece at a right angle.

Although the description above contains many specifications, these should not be construed as limiting the scope of the invention but as merely providing illustrations of some of the embodiments of this invention. Thus, the scope of the invention should be determined by the appended claims and their legal equivalents rather than by the examples given.

What is claimed is:

1. A fence assembly comprising:

a fence post having a rectangular cross-section;

a first fence rail having a rectangular cross-section;

a first fence brace member having a central wall and a pair of rearward-protruding side walls extending from opposing edges of the central wall, the sidewalls of the first fence brace member defining a channel for receiving the fence post therein and comprising a notch in a first of the side walls for receiving the fence rail, and a plurality of fastener holes disposed within the central wall and side walls of the first fence brace member for receiving fasteners to secure the first fence brace member to the fence post;

a vertical picket fastener slot longitudinally-extending through the central wall of the first fence brace member for receiving a fastener therethrough to affix a picket to the fence post with the first fence brace member therebetween; and a second fence brace member having a central wall and a pair of rearward-protruding side walls extending from opposing edges of the central wall, the sidewalls of the second fence brace member defining a channel for receiving the fence rail therein, and a plurality of fastener holes disposed within the central wall and side walls of the second fence brace member for receiving fasteners to secure the fence rail therewith;

a horizontal picket fastener slot latitudinally-extending through the central wall of the second fence brace member for receiving a fastener therethrough to affix a picket to the fence rail with the second fence brace member therebetween;

wherein the second fence brace member has a flap latitudinally-extending from an edge of the central wall and disposed to connect the second fence brace member to the fence post having a rectangular cross-section, a plurality of fastener holes disposed within the flap;

wherein the second fence brace member flap is further disposed to pass into the first fence brace member notch, between the first fence brace member central wall and the fence post, and behind the first fence brace member vertical picket slot and secured to the fence post by receiving one or more fasteners through one or more of the flap fastener holes.

2. The fence assembly of claim 1, wherein the first fence brace member and the second fence brace member are made of a material selected from the group consisting of steel, stainless steel, galvanized steel, aluminum, plastic, graphite, and composite material.

3. The fence assembly of claim 1, further comprising at least one picket, wherein the picket is fastened to the fence post by passing a fastener through the picket and through the vertical picket fastener slot and into the fence post.

4. The fence assembly of claim 1, further comprising at least one picket, wherein the picket is fastened to the fence rail by passing a fastener through the picket and through the horizontal picket fastener slot and into the fence rail.

* * * * *